US012800277B1

(12) United States Patent
McGuire

(10) Patent No.: US 12,800,277 B1
(45) Date of Patent: Nov. 17, 2026

(54) HUNTING PROJECTILE

(71) Applicant: Samuel McGuire, Paso Robles, CA (US)

(72) Inventor: Samuel McGuire, Paso Robles, CA (US)

( * ) Notice: Subject to any disclaimer, the term of this patent is extended or adjusted under 35 U.S.C. 154(b) by 0 days.

(21) Appl. No.: 18/207,422

(22) Filed: Jun. 8, 2023

(51) Int. Cl.
*F42B 10/24* (2006.01)
*F42B 10/44* (2006.01)
*F42B 30/02* (2006.01)

(52) U.S. Cl.
CPC ..... *F42B 10/24* (2013.01); *F42B 10/44* (2013.01); *F42B 30/02* (2013.01)

(58) Field of Classification Search
CPC ..... F42B 10/22; F42B 10/24; F42B 10/44; F42B 12/34; F42B 30/02
USPC ..... 102/501, 508, 509
See application file for complete search history.

(56) References Cited

U.S. PATENT DOCUMENTS 549,334 A * 11/1895 Smith ..... F42B 12/34 102/509
1,062,919 A * 5/1913 Johnson ..... F42B 12/34 102/509
1,095,501 A * 5/1914 Hoagland ..... F42B 12/34 102/513
1,141,212 A * 6/1915 Ross ..... F42B 12/34 102/509
1,252,325 A * 1/1918 Davison ..... F42B 12/34 102/509
1,493,614 A * 5/1924 Dickerman ..... F42B 12/34 102/510
1,512,026 A * 10/1924 Holden ..... F42B 12/34 102/509
1,556,160 A * 10/1925 Riggs ..... F42B 12/34 102/510
1,681,295 A * 8/1928 Johnson ..... F42B 12/34 102/509
1,709,414 A * 4/1929 Stendebach ..... F42B 12/34 102/509
3,349,711 A * 10/1967 Darigo ..... F42B 12/80 102/514
4,619,203 A * 10/1986 Habbe ..... F42B 12/78 102/516
4,685,397 A * 8/1987 Schirneker ..... F42B 12/34 102/501
4,776,279 A * 10/1988 Pejsa ..... F42B 12/34 102/514
4,836,110 A * 6/1989 Burczynski ..... F42B 12/34 102/501
5,259,320 A * 11/1993 Brooks ..... B21K 21/06 102/501

(Continued)

FOREIGN PATENT DOCUMENTS

FR 2647201 A * 11/1990 ..... F42B 10/22

*Primary Examiner* — Troy Chambers
*Assistant Examiner* — Benjamin S Gomberg
(74) *Attorney, Agent, or Firm* — Ervin Cohen & Jessup LLP; Kelly W. Cunningham

(57) ABSTRACT

A bullet is configured to utilize an unexposed hollow core to provide optimized drag and ballistics. The bullet has an ogive further comprising a tip with an unexposed hollow core. A bearing surface is extending from the ogive and further comprising a plurality of relief grooves. A boat tail, extending from the bearing surface. The boat tail reduces airflow behind the bullet to reduce drag.

7 Claims, 4 Drawing Sheets

(56) References Cited

U.S. PATENT DOCUMENTS

| | | | | |
|---|---|---|---|---|
| 5,686,693 | A * | 11/1997 | Jakobsson | F42B 14/02 102/515 |
| 7,299,750 | B2 * | 11/2007 | Schikora | F42B 12/34 102/508 |
| 7,380,502 | B2 * | 6/2008 | Emary | F42B 30/02 102/508 |
| 7,765,934 | B2 * | 8/2010 | Spatz | F42B 12/34 102/508 |
| 9,644,928 | B2 * | 5/2017 | Krause | F42B 30/02 |
| 10,684,108 | B2 * | 6/2020 | Peterson | F42B 5/025 |
| 11,313,657 | B1 * | 4/2022 | Agazim | F42B 12/78 |
| 11,428,517 | B2 * | 8/2022 | Agazim | F42B 12/06 |
| 2002/0139275 | A1 * | 10/2002 | Jensen | F42B 12/34 102/510 |
| 2005/0183616 | A1 * | 8/2005 | Eberhart | F42B 12/34 102/510 |
| 2006/0124022 | A1 * | 6/2006 | Eberhart | F42B 12/34 102/508 |
| 2010/0175576 | A1 * | 7/2010 | Weeks | F42B 12/78 102/517 |
| 2012/0085258 | A1 * | 4/2012 | Emary | F42B 12/34 102/517 |
| 2012/0111220 | A1 * | 5/2012 | King | F42B 12/34 102/509 |
| 2014/0318406 | A1 * | 10/2014 | Rall | F42B 12/34 102/510 |
| 2018/0094911 | A1 * | 4/2018 | Fournier | F42B 12/34 |
| 2018/0224249 | A1 * | 8/2018 | Carbone | F42B 12/34 |
| 2018/0245896 | A1 * | 8/2018 | Burczynski | F42B 12/34 |
| 2019/0017789 | A1 * | 1/2019 | Burczynski | F42B 30/02 |
| 2019/0277610 | A1 * | 9/2019 | Eberhart | F42B 12/78 |
| 2019/0316888 | A1 * | 10/2019 | Thielen | F42B 12/34 |
| 2020/0256656 | A1 * | 8/2020 | Thielen | F42B 10/46 |
| 2021/0341275 | A1 * | 11/2021 | Robbins | F42B 12/34 |
| 2022/0136810 | A1 * | 5/2022 | Weidemann | F42B 10/44 102/507 |
| 2023/0117770 | A1 * | 4/2023 | Spanner | B21K 1/025 102/509 |

* cited by examiner

HUNTING PROJECTILE

BACKGROUND

The embodiments herein relate generally to firearms and ammunition.

Prior to embodiments of the disclosed invention, projectiles would deform from launch.

SUMMARY

A bullet is configured to utilize an unexposed hollow core to provide optimized drag and ballistics. The bullet has an ogive further comprising a tip with an unexposed hollow core. A bearing surface is extending from the ogive and further comprising a plurality of relief grooves. A boat tail, extending from the bearing surface. The boat tail reduces airflow behind the bullet to reduce drag.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
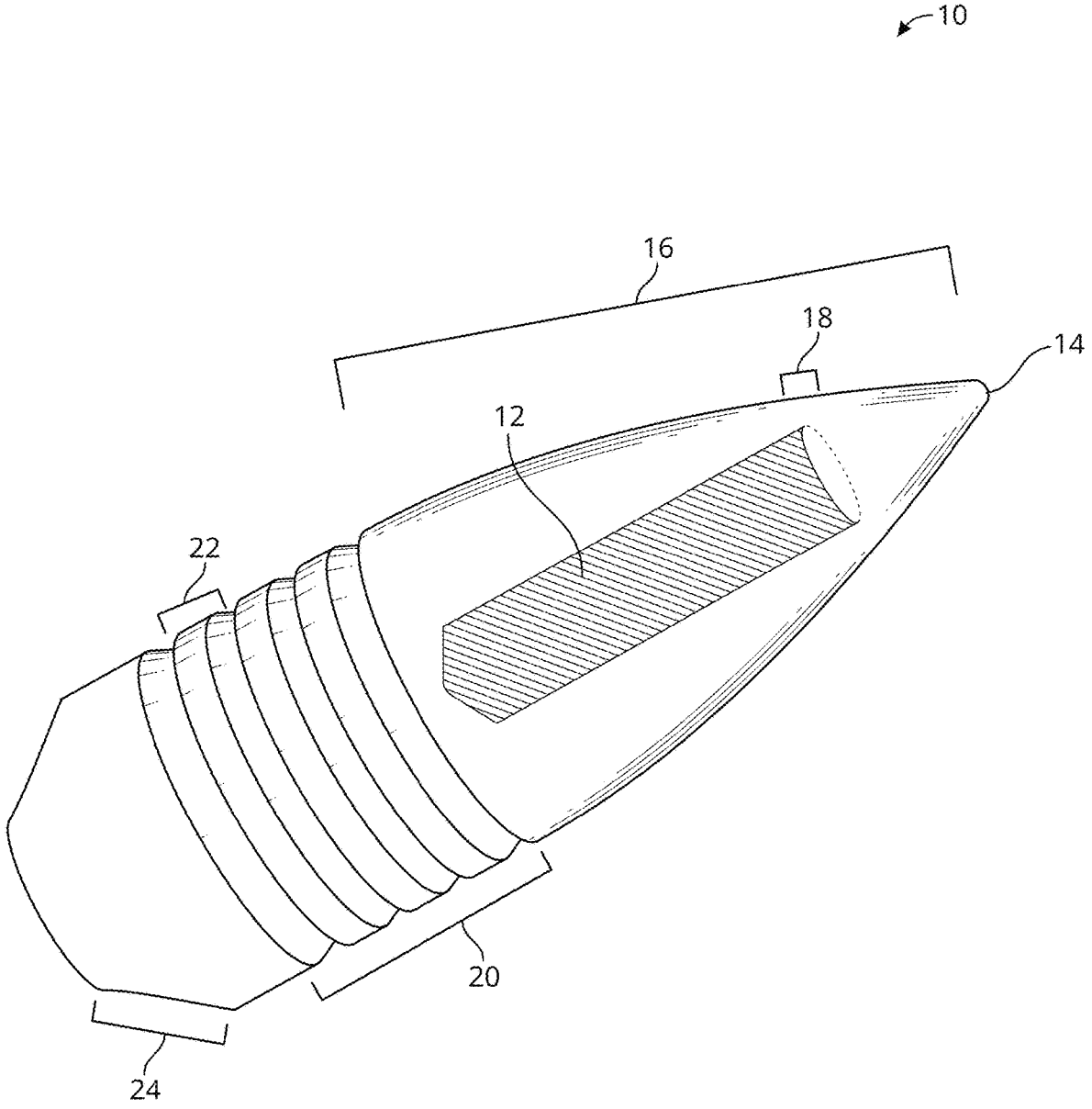
FIG. 1 shows a perspective view of one embodiment of the present invention.
Figure 2:
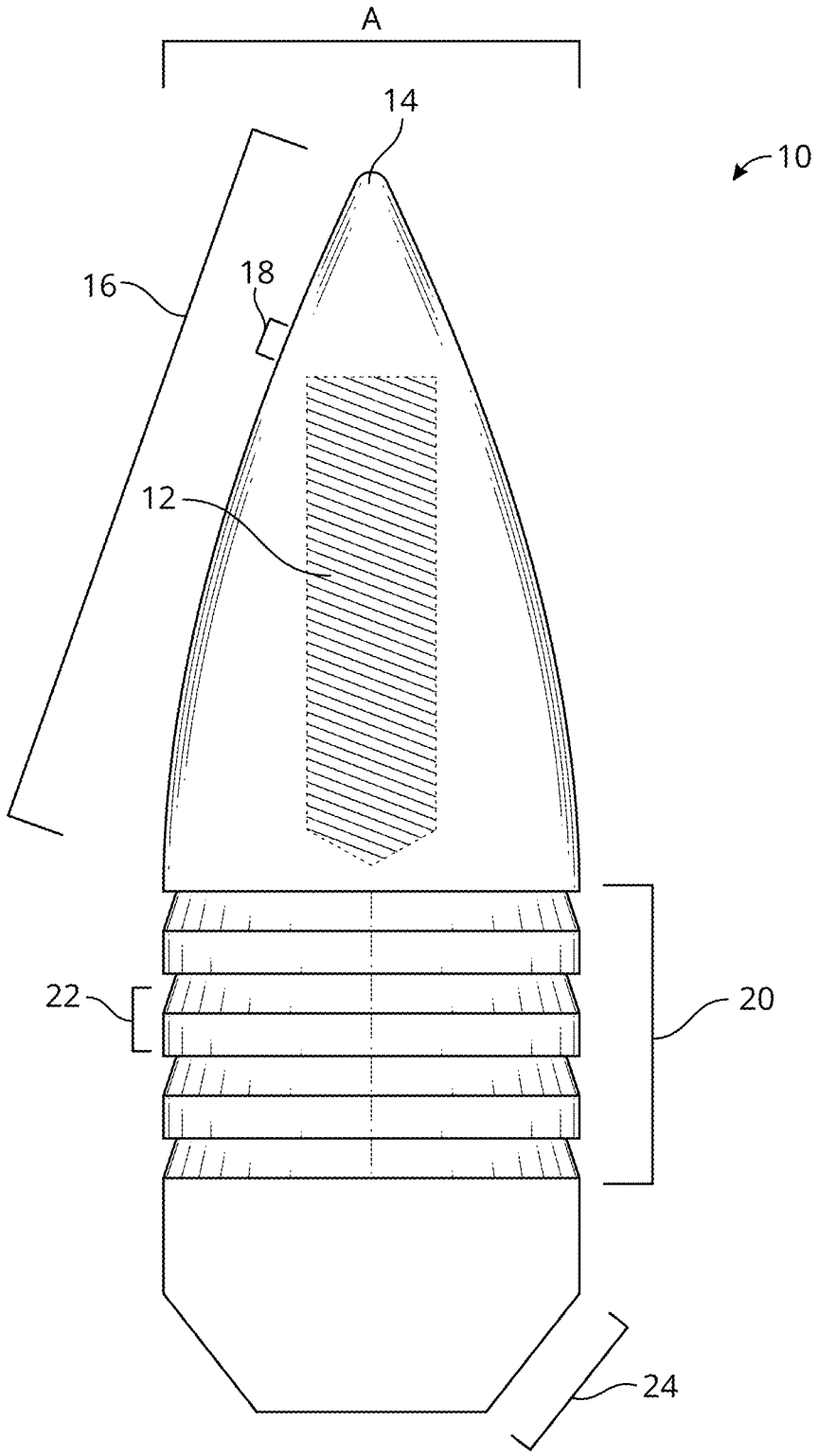
FIG. 2 shows a top view of one embodiment of the present invention.
Figure 3:
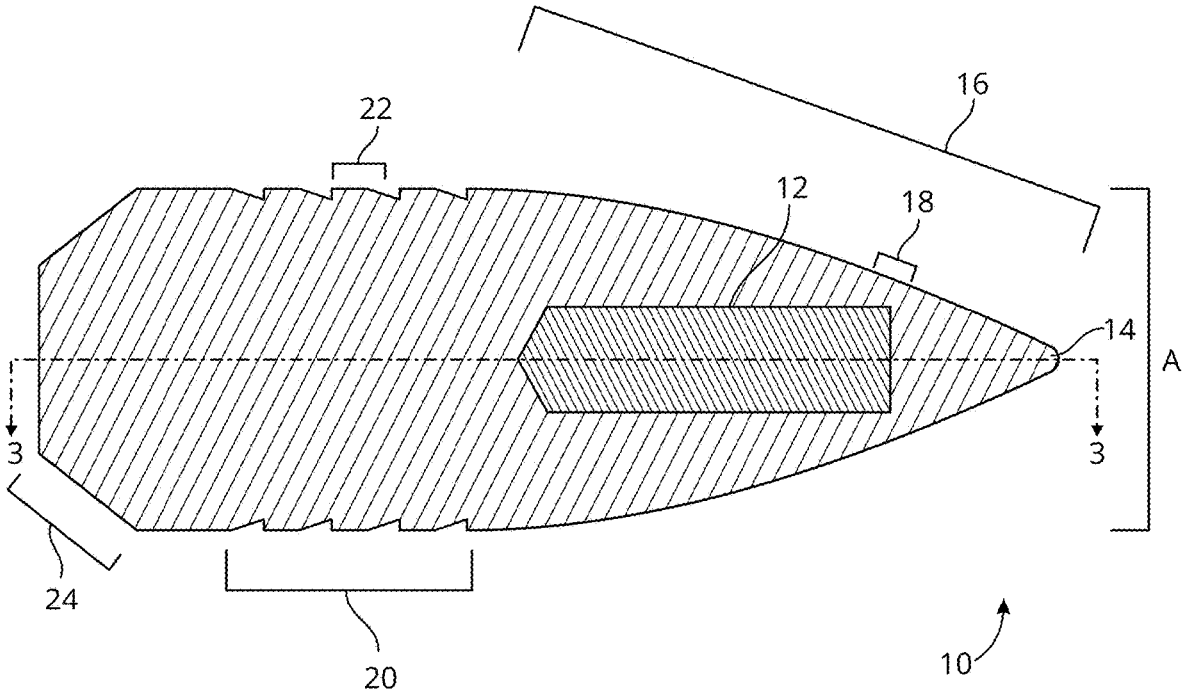
FIG. 3 shows a section view of one embodiment of the present invention.

By way of example, and referring to FIGS. 1-3, one embodiment of the projectile 10 further comprises a bearing surface 20 against an ogive 16 and a boat tail 24. The bearing surface 20 further comprises a plurality of relief grooves 22. Each relief groove 22 has a cylindrical portion adjacent to two frustoconical portions both of which incline toward a radial tip 14.

Figure 4:
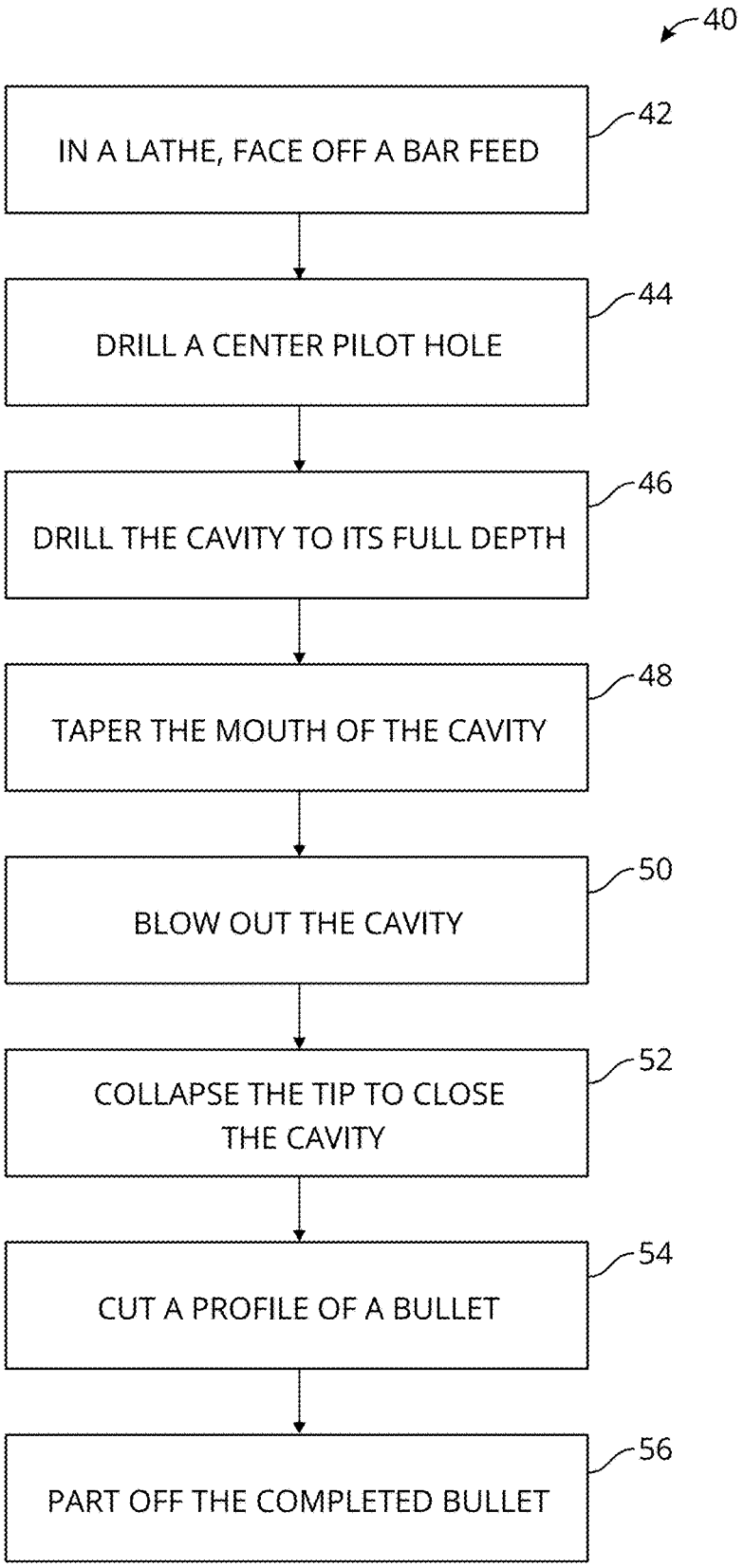
FIG. 4 shows a flow chart of one embodiment of the present invention.

The ogive 16 further comprises a radial tip 14 having an unexposed hollow core 12. The radial tip 14 has a wall thickness which is configured to have a breakpoint 18 of approximately one newton in order to expand on impact under velocities of 2000 feet per second without deforming in flight. The tip need not be a radial tip 14, but the radial tip is shown in the drawings. A distance from the unexposed hollow core to an inner edge of the radial tip is approximately equal to a maximum radius of the unexposed hollow core. The bearing surface is rifled to permit bullet material to deform while moving down a rifle Turning to FIG. 4, a process 40 for making a projectile 10 involves to the following steps. At step 42, facing off a bar feed in a lathe. Then, at step 44, drilling a center pilot hole thought the face. After that, at step 46, drill the pilot hole into a cavity at full depth. Following that at step 48, tapering a mouth of the cavity. Subsequently, at step 50, blowing out the cavity.

Next, at step 52, collapsing the tip to close the cavity into an internal chamber. Following that, at step 54, cutting a profile of a bullet. Finally, at step 56, parting offing the completed bullet.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶ 6. In particular, any use of "step of" in the claims is not intended to invoke the provision of 35 U.S.C. § 112, ¶ 6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A process for manufacturing a monolithic bullet comprising:

a) loading a single continuous bar feed of material into a lathe, b) boring a hollow core into a first end of the single continuous bar feed, c) tapering the first end of the single continuous bar fee using the lathe, d) collapsing the first end of the single continuous bar feed using the lathe to close the hollow core into an internal, unexposed hollow core and to form a tip of the monolithic bullet, e) turning the single continuous bar feed to machine a profile of the monolithic bullet by forming an ogive extending from the tip and a bearing surface extending from the ogive, and f) parting off the single continuous bar feed behind the bearing surface to form a back surface of the monolithic bullet, wherein the resulting monolithic bullet is made only from the single continuous bar feed of material, and is configured to utilize the unexposed hollow core to optimize drag and ballistics properties of the monolithic bullet.

2. The process of claim 1, further comprising before the boring step, facing off the continuous bar feed to form a clean front surface.

3. The process of claim 1, wherein a tip thickness is configured to have a breakpoint of approximately one newton in order to withstand extreme velocities measured at a muzzle of a firearm without the bullet deforming in flight, while expanding on impact.

4. The process of claim 1, wherein a distance from the hollow core to an inner edge of the tip is approximately equal to a maximum radius of the hollow core.

5. The process of claim 1, further comprising forming a plurality of relief grooves to allow fowled material a location to collect in order to reduce over pressure.

6. The process of claim 1, further comprising forming a boat tail extending from the back surface.

7. A monolithic bullet manufactured by the process of claim 1.

* * * * *